US010144897B2

(12) United States Patent
Saccomando et al.

(10) Patent No.: US 10,144,897 B2
(45) **Date of Patent: *Dec. 4, 2018**

(54) BASIC ASHLESS ADDITIVES

(71) Applicant: The Lubrizol Corporation, Wickliffe, OH (US)

(72) Inventors: Daniel J. Saccomando, Belper (GB); Ewan E. Delbridge, Concord Township, OH (US); Alexandre Roumaneix, Derby (GB)

(73) Assignee: The Lubrizol Corporation, Wickliffe, OH (US)

( * ) Notice: Subject to any disclaimer, the term of this patent is extended or adjusted under 35 U.S.C. 154(b) by 5 days.

This patent is subject to a terminal disclaimer.

(21) Appl. No.: 15/307,383

(22) PCT Filed: Apr. 28, 2015

(86) PCT No.: PCT/US2015/027958

§ 371 (c)(1),
(2) Date: Oct. 28, 2016

(87) PCT Pub. No.: WO2015/171356

PCT Pub. Date: Nov. 12, 2015

(65) Prior Publication Data

US 2017/0051225 A1 Feb. 23, 2017

Related U.S. Application Data

(60) Provisional application No. 61/989,306, filed on May 6, 2014.

(51) Int. Cl.

| | |
|---|---|
| ***C10M 137/10*** | (2006.01) |
| ***C10M 133/06*** | (2006.01) |
| ***C10M 135/14*** | (2006.01) |

(52) U.S. Cl.

CPC ..... *C10M 133/06* (2013.01); *C10M 135/14* (2013.01); *C10M 137/10* (2013.01); *C10M 2203/1006* (2013.01); *C10M 2203/1025* (2013.01); *C10M 2207/026* (2013.01); *C10M 2207/028* (2013.01); *C10M 2215/04* (2013.01); *C10M 2215/064* (2013.01); *C10M 2215/28* (2013.01); *C10M 2215/30* (2013.01); *C10M 2219/022* (2013.01); *C10M 2219/046* (2013.01); *C10M 2219/062* (2013.01); *C10M 2223/045* (2013.01); *C10N 2210/02* (2013.01); *C10N 2230/04* (2013.01); *C10N 2230/06* (2013.01); *C10N 2230/10* (2013.01); *C10N 2230/36* (2013.01); *C10N 2230/42* (2013.01); *C10N 2230/45* (2013.01); *C10N 2230/52* (2013.01)

(58) Field of Classification Search

CPC ..... C10M 133/06; C10M 133/10
USPC ..... 508/370
See application file for complete search history.

(56) References Cited

U.S. PATENT DOCUMENTS

2012/0015855 A1* 1/2012 Saccomando ..... C07C 211/21 508/476
2012/0040876 A1 2/2012 Preston et al.

FOREIGN PATENT DOCUMENTS

| | | | |
|---|---|---|---|
| WO | 2013013026 | A1 | 1/2013 |
| WO | 2014074335 | A1 | 5/2014 |
| WO | 2015171364 | A1 | 11/2015 |
| WO | 2015171674 | A1 | 11/2015 |

* cited by examiner

*Primary Examiner* — Prem C Singh
*Assistant Examiner* — Francis C Campanell
(74) *Attorney, Agent, or Firm* — Michael Miller; David Shold

(57) ABSTRACT

A lubricant composition comprising an oil of lubricating viscosity and an N-hydrocarbyl-substituted δ-aminoester or δ-aminothioester provides exhibits basicity and good seal performance. In certain embodiments the N-hydrocarbyl substituent comprises a hydrocarbyl group of at least 3 carbons atoms, with a branch at the 1 or 2 position of the hydrocarbyl chain.

9 Claims, No Drawings

BASIC ASHLESS ADDITIVES

BACKGROUND OF THE INVENTION

The disclosed technology relates to additives that impart basicity (measured as TBN) to a lubricant formulation without adding metal (measured as Sulfated Ash). The additives do not lead to deterioration of elastomer seals.

It is known that lubricants become less effective during their use due to exposure to the operating conditions of the device they are used in, and particularly due to exposure to by-products generated by the operation of the device. For example, engine oil becomes less effective during its use, in part due to exposure of the oil to acidic and pro-oxidant byproducts. These byproducts result from the incomplete combustion of fuel in devices such as internal combustion engines, which utilize the oil. These byproducts lead to deleterious effects in the engine oil and likewise in the engine. The byproducts may, for example, oxidize hydrocarbons found in the lubricating oil, yielding carboxylic acids and other oxygenates. These oxidized and acidic hydrocarbons can then go on to cause corrosion, wear and deposit problems.

Base-containing additives are added to lubricants in order to neutralize such byproducts, thus reducing the harm they cause to the lubricant and to the device. Over-based calcium or magnesium carbonate detergents have been used for some time as acid scavengers, neutralizing these byproducts and so protecting both the lubricant and the device. However, over-based detergents carry with them an abundance of metal as measured by sulfated ash. New industry upgrades for diesel and passenger car lubricating oils are putting ever decreasing limits on the amount of sulfated ash, and by extension the amount of over-based detergent, permissible in an oil. Therefore, a source of base that consists of only N, C, H, and O atoms is extremely desirable.

There are two common measures of basicity that are used in the field of lubricant additives. Total Base Number (TBN) may be as measured by ASTM D 2896, which is a titration that measures both strong and weak bases. On the other hand, ASTM D 4739 is a titration that measures strong bases but does not readily titrate weak bases such as certain amines, including many aromatic amines. Many lubricant applications desire TBN as measured by ASTM D 4739, making many amities less than satisfactory sources of basicity.

Basic amine additives have nevertheless been investigated as alternatives to ash containing over-based metal detergents, for example, alkyl and aromatic amines. However, the addition of basic amine additives can lead to additional detrimental effects. For example, it is known that alkyl and some aromatic amines tend to degrade fluoroelastomeric seals materials. These basic amine additives, such as succinimide dispersants, contain polyamine groups, which provide a source of basicity. However, such amines are believed to cause dehydrofluorination in fluoroelastomeric seals materials, such as Viton® seals, which is believed to be a first step in seals degradation. Seal degradation may lead to seal failure, such as seal leaks, harming engine performance and possibly causing engine damage. Generally, the base content, or total base number (TBN), of a lubricant can only be boosted modestly by such a basic amine before seals degradation becomes a significant issue, limiting the amount of TBN that can be provided by such additives.

U.S. Patent Publication 2012-0040876, Preston et al., Feb. 16, 2012, discloses anthranilic esters as additives in lubricants. This document discloses compositions that are said to deliver an ash-free base to a lubricant in the form of a basic amine additive, without adversely impacting seal compatibility. The examples report TBN values of 150-188 as measured by D2896. (D 2896 measurement captures the basicity of weak bases as well as strong bases.)

The disclosed technology, therefore, solves the problem of providing strong basicity, as measured by ASTM D 4739, to a lubricant, without imparting additional metal content (sulfated ash) thereto and while not leading to deterioration of elastomeric seals such as fluorocarbon seals, as measured by the Mercedes Benz supply specification MB DBL6674_FKM. This is accomplished by employing an N-hydrocarbyl-substituted δ-aminoester or δ-aminothioester as more fully described herein. As otherwise expressed, the technology provides the ability to impart relatively high TBN levels to a lubricant while maintaining the low sulfated ash levels specified by increasingly stringent governmental regulations, while at the same time protecting seal performance and compatibility.

SUMMARY OF THE INVENTION

The disclosed technology provides a lubricant composition comprising an oil of lubricating viscosity and an N-hydrocarbyl-substituted δ-aminoester or δ-aminothioester. In certain embodiments the N-hydrocarbyl substituent comprises a hydrocarbyl group of at least 3 carbons atoms, with a branch at the 1 or 2 position of the hydrocarbyl chain (that is, of the hydrocarbyl group). Further, in certain embodiments, if the ester or thioester is a methyl ester or methyl thio ester then the hydrocarbyl group has a branch at the 1 position, and the hydrocarbyl group is not a tertiary group.

DETAILED DESCRIPTION OF THE INVENTION

Various preferred features and embodiments will be described below by way of non-limiting illustration.

The disclosed technology will typically be presented in a lubricant or lubricant formulation, one component of which will be an oil of lubricating viscosity. The oil of lubricating viscosity, also referred to as a base oil, may be selected from any of the base oils in Groups I-V of the American Petroleum Institute (API) Base Oil Interchangeability Guidelines, namely

| Base Oil Category | Sulfur (%) | | Saturates(%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | >120 |
| Group IV | All polyalphaolefins (PAOs) | | | |
| Group V | All others not included in Groups I, II, III or IV | | | |

Groups I, II and III are mineral oil base stocks. The oil of lubricating viscosity can include natural or synthetic oils and mixtures thereof. Mixture of mineral oil and synthetic oils, e.g., polyalphaolefin oils and/or polyester oils, may be used.

Natural oils include animal oils and vegetable oils (e.g. vegetable acid esters) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are also useful oils of lubricating viscosity. Oils of lubricating viscosity derived from coal or shale are also useful.

Synthetic oils include hydrocarbon oils and halosubstituted hydrocarbon oils such as polymerized and interpolymerized olefins and mixtures thereof, alkylbenzenes, polyphenyl, alkylated diphenyl ethers, and alkylated diphenyl sulfides and their derivatives, analogs and homologues thereof. Alkylene oxide polymers and interpolymers and derivatives thereof, and those where terminal hydroxyl groups have been modified by, e.g., esterification or etherification, are other classes of synthetic lubricating oils. Other suitable synthetic lubricating oils comprise esters of dicarboxylic acids and those made from C5 to C12 monocarboxylic acids and polyols or polyol ethers. Other synthetic lubricating oils include liquid esters of phosphorus-containing acids, polymeric tetrahydrofurans, silicon-based oils such as poly-alkyl-, polyaryl-, polyalkoxy-, or polyaryloxy-siloxane oils, and silicate oils.

Other synthetic oils include those produced by Fischer-Tropsch reactions, typically hydroisomerized Fischer-Tropsch hydrocarbons or waxes. In one embodiment oils may be prepared by a Fischer-Tropsch gas-to-liquid synthetic procedure as well as other gas-to-liquid oils.

Unrefined, refined and rerefined oils, either natural or synthetic (as well as mixtures thereof) of the types disclosed hereinabove can used. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Rerefined oils often are additionally processed to remove spent additives and oil breakdown products.

The lubricant composition of the disclosed technology will include an N-hydrocarbyl-substituted δ-aminoester or δ-aminothioester. A substituted δ-aminoester may be most generally depicted as a material represented by the formula

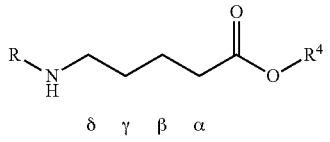

where R is the hydrocarbyl substituent and $R^4$ is the residue of the alcohol from which the ester may be envisioned as having been prepared by condensation of an amino acid with an alcohol. Additional substituents may be present at the α, β, γ, and δ positions, as described below. If the material is a thioester, the —$OR^4$ group may be replaced by an —$SR^4$ group. Such a material may be envisioned as derived from the condensation of an acid or acid halide with an appropriate mercaptan $R^4SH$, although in practice it may be prepared by transesterification of an ester with a mercaptan.

The group $R^4$, the alcohol residue portion, may have 1 to 30 or 1 to 18 or 1 to 12 or 2 to 8 carbon atoms. It may be a hydrocarbyl group or a hydrocarbon group. It may be aliphatic, cycloaliphatic, branched aliphatic, or aromatic. In certain embodiments, the $R^4$ group may methyl, ethyl, propyl, isopropyl, n-butyl, iso-butyl, t-butyl, n-hexyl, cyclohexyl, iso-octyl, or 2-ethylhexyl. If $R^4$ is methyl, then the R group, the hydrocarbyl substituent on the nitrogen, will have a branch at the 1-position.

In other embodiments the $R^4$ group may be an ether-containing group. For instance, it may be a ether-containing group or a polyether-containing group which may contain, for instance 2 to 120 carbon atoms along with oxygen atoms representing the ether functionality. When $R^4$ is an ether-containing group, it may be represented by the general formula

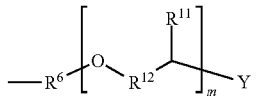

wherein $R^6$ is a hydrocarbyl group of 1 to 30 carbon atoms; $R^{11}$ is H or a hydrocarbyl group of 1 to about 10 carbon atoms; $R^{12}$ is a straight- or branched-chain hydrocarbylene group of 1 to 6 carbon atoms; Y is —H, —OH, —$R^6$OH, —$NR^9R^{10}$, or —$R^6NR^9R^{10}$, where $R^9$ and $R^{10}$ are each independently H or a hydrocarbyl group of 1 to 50 carbon atoms, and m is an integer from 2 to 50. An example of a mono-ether group would be —$CH_2$—O—$CH_3$. Polyether groups include groups based on poly(alkylene glycols) such as polyethylene glycols, polypropylene glycols, and poly (ethylene/propylene glycol) copolymers. Such polyalkylene glycols are commercially available under the trade names UCON® OSP Base fluids, Synalox® fluids, and Brij® polyalkylene glycols. They may be terminated with an alkyl group (that is, Y is H) or with a hydroxy group or other such groups as mentioned above. If the terminal group is OH, then $R^4$ would also be considered a hydroxy-containing group, much as described in the paragraph below (albeit not specifically a hydroxy-containing alkyl group) and may be esterified as described in the paragraph below.

In another embodiment, $R^4$ can be a hydroxy-containing alkyl group or a polyhydroxy-containing alkyl group having 2 to 12 carbon atoms. Such materials may be based on a diol such as ethylene glycol or propylene glycol, one of the hydroxy groups of which may be reacted to form the ester linkage, leaving one unesterified hydroxy group. Another example of a material may be glycerin, which, after condensation, may leave one or two hydroxy groups. Other polyhydroxy materials include pentaerythritol and trimethylolpropane. Optionally, one or more of the hydroxy groups may be reacted to form an ester or a thioester. In one embodiment, one or more of the hydroxy groups within $R^4$ may be condensed with or attached to an additional

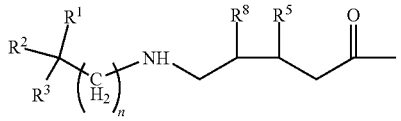

group or, more generally, a

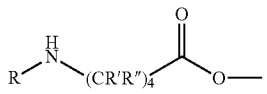

group (as described more fully below), so as to from a bridged species.

There may also be one or more additional substituents or groups at the α, β, γ or δ positions of the amino acid component of the above molecule, represented in the structures above as $R^5$ and $R^8$ or, alternatively, as R' and R". $R^5$ and $R^8$, as well as R' and R", may each be the same or different and may be hydrogen, a hydrocarbyl group, or a group represented by —C(=O)—$R^6$ where $R^6$ is hydrogen, an alkyl group, or —X'—$R^7$, where X' is O or S and $R^7$ is a hydrocarbyl group of 1 to 30 carbon atoms. In one embodiment there are no such substituents. In another embodiment there is a substituent at the β position (relative to the carboxylic acid moiety), thus leading to a group of materials represented by the formula

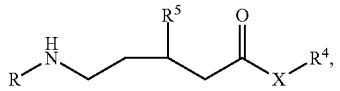

or, more generally,

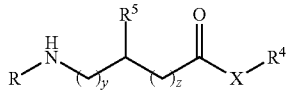

Here R and $R^4$ are as defined above; X is O or S (in one embodiment, O) $R^5$ may be hydrogen or a hydrocarbyl group, and y and z are integers from 0 to 3 such that y+z=3.

The hydrocarbyl substituent R on the amine nitrogen may typically comprise a hydrocarbyl group of at least 3 carbon atoms with a branch at the 1 or 2 (that is, α or β) position of the hydrocarbyl chain (not to be confused with the α or β position of the ester group, above). The branched hydrocarbyl group R may be represented by the partial formula

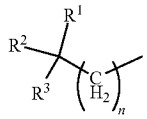

where the bond on the right represents the point of attachment to the nitrogen atom. In this partial structure, n is 0 or 1, $R^1$ is hydrogen or a hydrocarbyl group, $R^2$ and $R^3$ are independently hydrocarbyl groups or together form a carbocyclic structure. The hydrocarbyl groups may be aliphatic, cycloaliphatic, or aromatic, or mixtures thereof. When n is 0, the branching is at the 1 or α position. When n is 1, the branching is at the 2 or β position. If $R^4$, above, is methyl, then n will be 0.

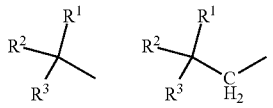

1- or α branching 2- or β branching

There may, of course, be branching both at the 1 position and the 2 position. Attachment to a cyclic structure is to be considered branching:

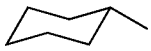

(a type of 1- or α branching)

The branched hydrocarbyl substituent R on the amine nitrogen may thus include such groups as isopropyl, cyclopropyl, sec-butyl, iso-butyl, t-butyl, 1-ethylpropyl, 1,2-dimethylpropyl, neopentyl, cyclohexyl, 4-heptyl, 2-ethyl-1-hexyl (commonly referred to as 2-ethylhexyl), t-octyl (for instance, 1,1-dimethyl-1-hexyl), 4-heptyl, 2-propylheptyl, adamantyl, and α-methylbenzyl.

The amine that may be seen as reacting to form the material of the present technology will typically be a primary amine, so that the resulting product will be a secondary amine, having a branched R substituent as described above and the nitrogen also being attached to the remainder of the molecule

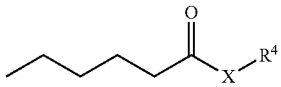

and substituted versions thereof as described above. The left-most (short) bond represents the attachment to the nitrogen atom.

The materials of the disclosed technology may therefore, in certain embodiments, be represented by the structures

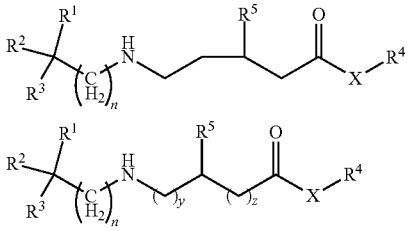

or wherein n is 0 or 1, $R^1$ is hydrogen or a hydrocarbyl group, $R^2$ and $R^3$ are independently hydrocarbyl groups or together form a carbocyclic structure, X is O or S, $R^4$ is a hydrocarbyl group of 1 to 30 carbon atoms, $R^5$ is hydrogen or a hydrocarbyl group, and y and z are integers from 0 to 3 such that y+z=3.

The N-hydrocarbyl-substituted δ-aminoester or δ-aminothioester materials disclosed herein may be prepared by reductive amination of the esters of 5-oxy substituted carboxylic acids or 5-oxy substituted thiocarboxylic acids.

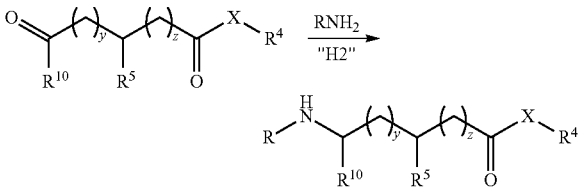

wherein R, $R^4$, $R^5$, X, y, and z are as defined above, and $R^{10}$ is H or an alkyl group having 1 to 4 carbon atoms. For example, reaction of α-methyl benzyl amine with butyl 5-oxopentanoate followed by selective hydrogenation of the resulting imine would yield butyl 5-(benzylamino)pentanoate:

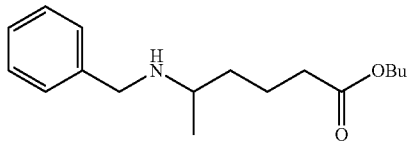

The N-hydrocarbyl-substituted δ-aminoester or δ-aminothioester materials disclosed herein may be prepared by amination of the esters of 5-halogen substituted carboxylic acids or 5-halogen substituted thiocarboxylic acids.

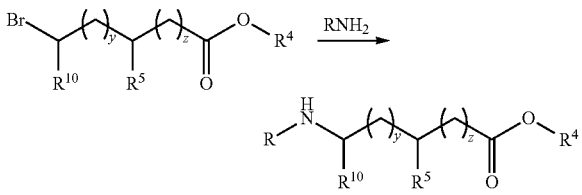

wherein R, $R^4$, $R^5$, $R^{10}$ X, y, and z are as defined above. For example reaction of α-methylbenzyl amine with 2-ethylhexyl 5-bromohexanoate would yield the hydrobromide salt of 2-ethylhexyl 5-(benzylamino)hexanoate.

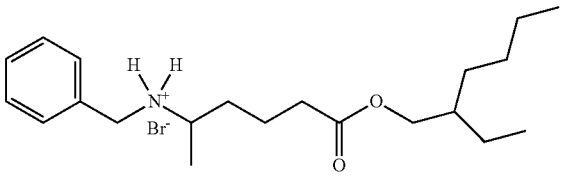

In such instances, when a hydrohalide is formed, the halide may be removed by known methods to obtain the amine.

The N-hydrocarbyl-substituted amino ester materials disclosed herein may be prepared by reductive amination of the esters of 2-amino substituted hexanedioc acids.

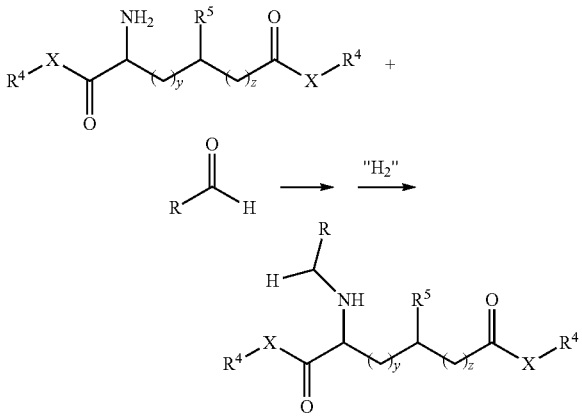

wherein R, $R^4$, $R^5$, X, y, and z are as defined above. For example, the reaction of the dibutyl ester of 2-aminoadipic acid with benzaldehyde followed by selective hydrogenation of the imine would yield dibutyl 2-(benzylamino)hexanedioate.

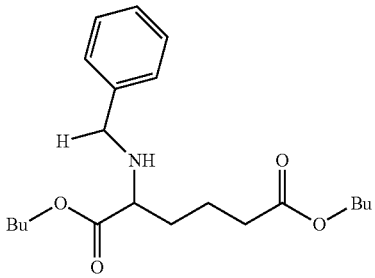

The N-hydrocarbyl-substituted aminoester materials disclosed herein may also be prepared by alkylation of the esters of 2-amino hexanedioc acids.

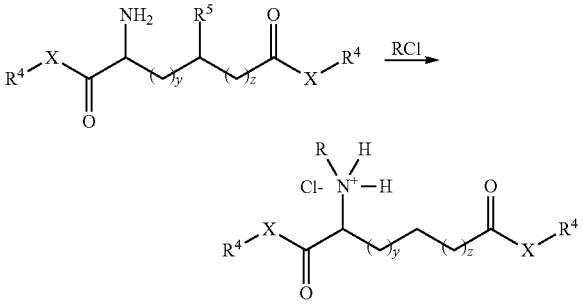

wherein x and y are 0 or 1 provided that x+y=1 or 2, and R, $R^4$, $R^5$ are as defined above. For example, the reaction of the dibutyl ester of 2-aminoadipic acid with benzyl amine would yield N-benzyl-1,6-dibutoxy-1,6-dioxohexane-2-aminium chloride.

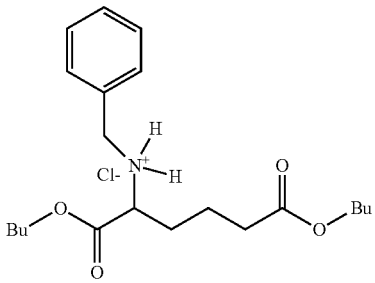

In another embodiment, there may also be one or more additional substituents or groups at the α, β, γ or δ positions (relative to the carboxylic acid moiety) of the amino acid component of the above molecule. In one embodiment there is a substituent at the γ and/or β position, thus leading to a group of materials represented by the formula

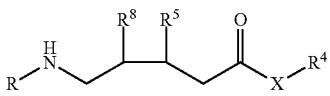

In another embodiment there may be a substituent at the δ position, providing a structure such as

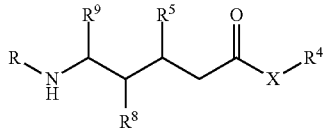

Here R and $R^4$ are as defined above; X is O or S (in one embodiment, O) and $R^5$ and $R^8$ and $R^9$ may be the same or different and may be hydrogen, a hydrocarbyl group, or a group represented by —C(═O)—$R^6$ where $R^6$ is hydrogen, an alkyl group, or —X'—$R^7$, where X' is O or S and $R^7$ is a hydrocarbyl group of 1 to 30 carbon atoms. That is, a substituent at the β, γ or δ position of the chain may comprise an ester, thioester, carbonyl, or hydrocarbyl group. When $R^8$ is —C(═O)—$R^6$, the structure may be represented by

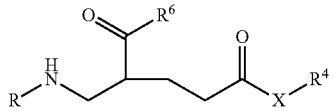

It will be evident that when $R^6$ is —X'—$R^7$ the material will be a substituted pentanedioic acid ester or thioester. In particular, in one embodiment the material may be 2-methyl pentanedioic acid diester, with amine substitution on the methyl group. The $R^4$ and $R^6$ groups may be the same or different; in certain embodiments they may independently have 1 to 30 or 1 to 18 carbon atoms, as described above for $R^4$. In certain embodiments, the material may be represented by the structure

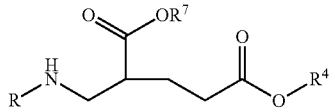

In certain embodiments the material will be or will comprise a 2-((hydrocarbyl)-aminomethyl pentanedioic acid dihydrocarbyl ester.

In certain embodiments there may be a substituent at both the β and γ position (relative to the carboxylic acid moiety) of the amino acid thus leading to a group of materials represented by the formula

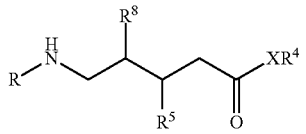

Here R and $R^4$ are as defined above; X may be O or S (in one embodiment, O) and $R^5$ and $R^8$ may be the same or different and may be hydrogen, a hydrocarbyl group, or a group represented by —C(═O)—$R^6$ where $R^6$ may be hydrogen, an alkyl group, or —X—$R^7$, where X' may be O or S and $R^7$ may be a hydrocarbyl group of 1 to 30 carbon atoms. When $R^5$ and $R^8$ are —C(═O)—$R^6$, the structure may be represented by

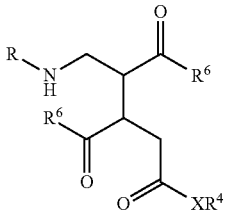

It will be evident that when $R^6$ is —X'—$R^7$ the material will be a substituted 1,2,3-tricarboxylic acid ester or thioester. In particular, in one embodiment the material may be a trihydrocarbyl 4-(hydrocarbylamino)alkane-1,2,3-tricarboxylate or a trihydrocarbyl 4-(hydrocarbylamino)butane-1,2,3-tris (carboxylothioate). In certain embodiments the material may be represented by the structure

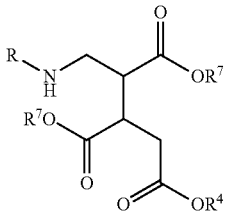

The hydrocarbyl substituent R on the amine nitrogen may be as described above.

The materials of the disclosed technology may therefore, in certain embodiments, be represented by the structures

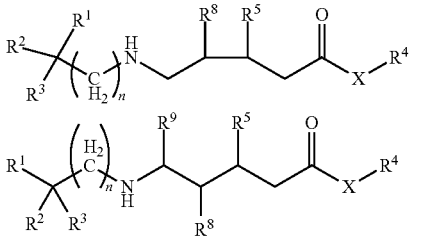

or wherein n is 0 or 1, $R^1$ is hydrogen or a hydrocarbyl group, $R^2$ and $R^3$ are independently hydrocarbyl groups or together form a carbocyclic structure, X is O or S, $R^4$ is a hydrocarbyl group of 1 to 30 carbon atoms, and $R^5$, $R^8$, and $R^9$ are the same or different and are hydrogen or a hydrocarbyl group, or a group represented by —C(═O)—$R^6$ where $R^6$ is hydrogen, an alkyl group, or where X' is O or S and $R^7$ is a hydrocarbyl group of 1 to 30 carbon atoms. In certain embodiments, the materials may be represented by the structure

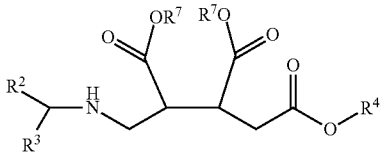

wherein $R^2$ and $R^3$ are independently alkyl groups of 1 to 6 carbon atoms and $R^4$ and $R^7$ are independently alkyl groups of 1 to 12 carbon atoms. In other embodiments, the materials may be represented by the structure

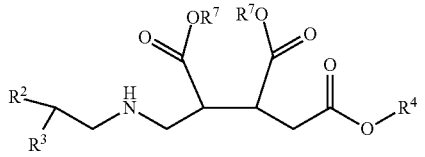

wherein $R^2$, $R^3$, and $R^4$, are as defined above and $R^7$ is an alkyl group of 1 to 12 carbon atoms.

The N-hydrocarbyl-substituted δ-aminoester or δ-aminothioester materials disclosed herein may be prepared by a Michael addition of a primary amine, having a branched hydrocarbyl group as described above, with an ethylenically unsaturated ester or thio ester of the type described above having an ester or other activating group as $R^8$ at the γ position. The ethylenic unsaturation would be between the γ and δ carbon atoms of the ester. Thus, the reaction may occur generally as

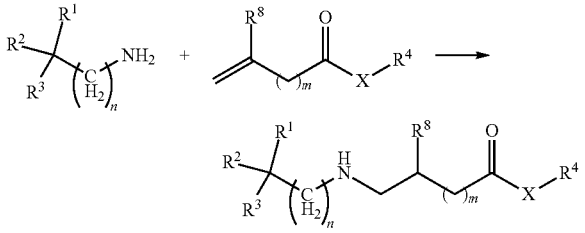

where the X and various R groups are as defined above and m=2. In one embodiment the ethylenically unsaturated ester may be an ester of 2-methylene glutaric acid (also known as an ester of 2-methylene pentanedioic acid) in which the reaction may be

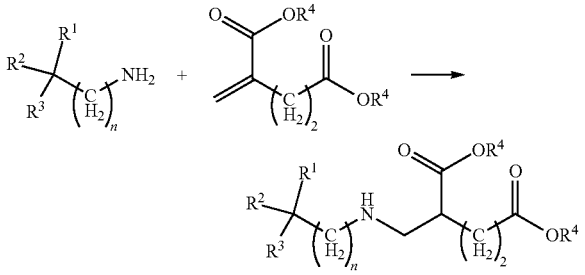

In one embodiment the ethylenically unsaturated ester may be an ester of a but-3-ene-1,2,3-tricarboxylic acid in which the reaction may be

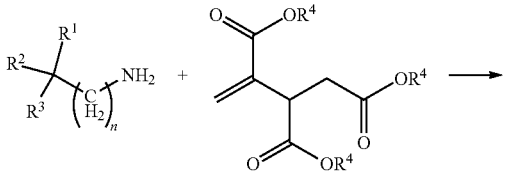

-continued

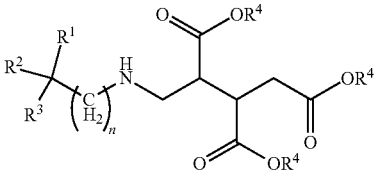

In one embodiment, the amine reactant is not a tertiary hydrocarbyl (e.g., t-alkyl) primary airline, that is, n is not zero while $R^1$, $R^2$, and $R^3$ are each hydrocarbyl groups. The synthesis of the N-hydrocarbyl-substituted δ-aminoester or δ-aminothioester may be conducted at temperatures of 10 to 80° C. or 10 to 33° C. or 45 to 55° C. or 20 to 40° C.

The amount of the N-hydrocarbyl-substituted δ-aminoester or δ-aminothioester material in a lubricant may be 0.5 to 5 percent by weight (or 0.8 to 4 or 1 to 3 percent by weight). The material may also be present in a concentrate, alone or with other additives and with a lesser amount of oil. In a concentrate, the amount of material may be two to ten times the above concentration amounts. In a lubricant, the amount may be suitable to provide at least 0.3, 0.5, 0.7, or 1.0 TBN to the lubricant, and in some embodiments up to 5 or 4 or 3 TBN.

The lubricant of the disclosed technology may contain one or more additional components or additives desirable to provide the performance properties of a fully formulated lubricant, e.g., an engine oil. Alternatively, any one or more of these components may be excluded from the formulation.

One material that may be used in a lubricant is a detergent. Detergents are typically overbased materials, otherwise referred to as overbased or superbased salts, which are generally homogeneous Newtonian systems having by a metal content in excess of that which would be present for neutralization according to the stoichiometry of the metal and the detergent anion. The amount of excess metal is commonly expressed in terms of metal ratio, that is, the ratio of the total equivalents of the metal to the equivalents of the acidic organic compound. Overbased materials are prepared by reacting an acidic material (such as carbon dioxide) with an acidic organic compound, an inert reaction medium (e.g., mineral oil), a stoichiometric excess of a metal base or a quaternary ammonium base, and a promoter such as a phenol or alcohol. The acidic organic material will normally have a sufficient number of carbon atoms, to provide oil-solubility.

Overbased detergents may be characterized by Total Base Number (TBN), the amount of strong acid needed to neutralize all of the material's basicity, expressed as mg KOH per gram of sample. Since overbased detergents are commonly provided in a form which contains diluent oil, for the purpose of this document, TBN is to be recalculated (when referring to a detergent or specific additive) to an oil-free basis. Some useful detergents may have a TBN of 100 to 800, or 150 to 750, or, 400 to 700.

The metal compounds useful in making the basic metal salts are generally any Group 1 or Group 2 metal compounds (CAS version of the Periodic Table of the Elements). Examples include alkali metals such as sodium, potassium, lithium, copper, magnesium, calcium, barium, zinc, and cadmium. In one embodiment the metals are sodium, magnesium, or calcium. The anionic portion of the salt can be hydroxide, oxide, carbonate, borate, or nitrate.

In one embodiment the lubricant can contain an overbased sulfonate detergent. Suitable sulfonic acids include sulfonic and thiosulfonic acids, including mono or polynuclear aromatic or cyclo-aliphatic compounds. Certain oil-soluble sulfonates can be represented by $R^2$-T$(SO_3^-)_a$ or $R^3(SO_3^-)_b$, where a and b are each at least one; T is a cyclic nucleus such as benzene or toluene; $R^2$ is an aliphatic group such as alkyl, alkenyl, alkoxy, or alkoxyalkyl; ($R^2$)-T typically contains a total of at least 15 carbon atoms; and $R^3$ is an aliphatic hydrocarbyl group typically containing at least 15 carbon atoms. The groups T, $R^2$, and $R^3$ can also contain other inorganic or organic substituents. In one embodiment the sulfonate detergent may be a predominantly linear alkylbenzenesulfonate detergent having a metal ratio of at least 8 as described in paragraphs [0026] to [0037] of US Patent Application 2005-065045. In some embodiments the linear alkyl group may be attached to the benzene ring anywhere along the linear chain of the alkyl group, but often in the 2, 3 or 4 position of the linear chain, and in some instances predominantly in the 2 position.

Another overbased material is an overbased phenate detergent. The phenols useful in making phenate detergents can be represented by $(R^1)_a$—Ar—$(OH)_b$, where $R^1$ is an aliphatic hydrocarbyl group of 4 to 400 or 6 to 80 or 6 to 30 or 8 to 25 or 8 to 15 carbon atoms; Ar is an aromatic group such as benzene, toluene or naphthalene; a and b are each at least one, the sum of a and b being up to the number of displaceable hydrogens on the aromatic nucleus of Ar, such as 1 to 4 or 1 to 2. There is typically an average of at least 8 aliphatic carbon atoms provided by the $R^1$ groups for each phenol compound. Phenate detergents are also sometimes provided as sulfur-bridged species.

In one embodiment, the overbased material is an overbased saligenin detergent. Overbased saligenin detergents are commonly overbased magnesium salts which are based on saligenin derivatives. A general example of such a saligenin derivative can be represented by the formula

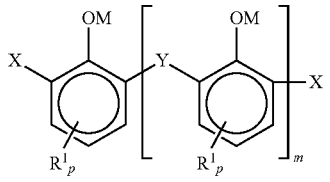

where X is —CHO or —$CH_2OH$, Y is —$CH_2$— or —$CH_2OCH_2$—, and the —CHO groups typically comprise at least 10 mole percent of the X and Y groups; M is hydrogen, ammonium, or a valence of a metal ion (that is, if M is multivalent, one of the valences is satisfied by the illustrated structure and other valences are satisfied by other species such as anions or by another instance of the same structure), $R^1$ is a hydrocarbyl group of 1 to 60 carbon atoms, m is 0 to typically 10, and each p is independently 0, 1, 2, or 3, provided that at least one aromatic ring contains an $R^1$ substituent and that the total number of carbon atoms in all $R^1$ groups is at least 7. When m is 1 or greater, one of the X groups can be hydrogen. In one embodiment, M is a valence of a Mg ion or a mixture of Mg and hydrogen. Saligenin detergents are disclosed in greater detail in U.S. Pat. No. 6,310,009, with special reference to their methods of synthesis (Column 8 and Example 1) and preferred amounts of the various species of X and Y (Column 6).

Salixarate detergents are overbased materials that can be represented by a compound comprising at least one unit represented by formula (I) or formula (II):

(I)

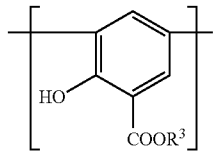

(II)

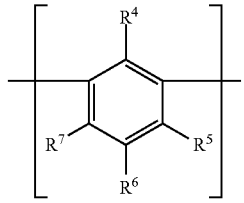

each end of the compound having a terminal group represented by formula (III) or (IV):

(III)

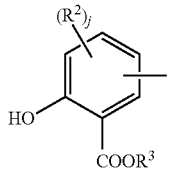

(IV)

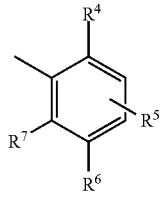

such groups being linked by divalent bridging groups A, which may be the same or different. In formulas (I)-(IV) $R^3$ is hydrogen, a hydrocarbyl group, or a valence of a metal ion or an ammonium ion; $R^2$ is hydroxyl or a hydrocarbyl group, and j is 0, 1, or 2; $R^6$ is hydrogen, a hydrocarbyl group, or a hetero-substituted hydrocarbyl group; either $R^4$ is hydroxyl and $R^5$ and $R^7$ are independently either hydrogen, a hydrocarbyl group, or hetero-substituted hydrocarbyl group, or else $R^5$ and $R^7$ are both hydroxyl and $R^4$ is hydrogen, a hydrocarbyl group, or a hetero-substituted hydrocarbyl group; provided that at least one of $R^4$, $R^5$, $R^6$ and $R^7$ is hydrocarbyl containing at least 8 carbon atoms; and wherein the molecules on average contain at least one of unit (I) or (III) and at least one of unit (II) or (IV) and the ratio of the total number of units (I) and (III) to the total number of units of (II) and (IV) in the composition is 0.1:1 to 2:1. The divalent bridging group "A," which may be the same or different in each occurrence, includes —$CH_2$— and —$CH_2OCH_2$—, either of which may be derived from formaldehyde or a formaldehyde equivalent (e.g., paraform, formalin).

Salixarate derivatives and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate."

Glyoxylate detergents are similar overbased materials which are based on an anionic group which, in one embodiment, may have a structure represented by

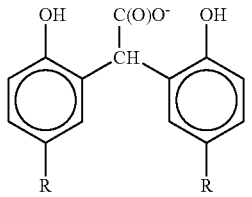

wherein each R is independently an alkyl group containing at least 4 or 8 carbon atoms, provided that the total number of carbon atoms in all such R groups is at least 12 or 16 or 24. Alternatively, each R can be an olefin polymer substituent. The acidic material upon from which the overbased glyoxylate detergent is prepared may be a condensation product of a hydroxyaromatic material such as a hydrocarbyl-substituted phenol with a carboxylic reactant such as glyoxylic acid or another omega-oxoalkanoic acid. Overbased glyoxylic detergents and their methods of preparation are disclosed in greater detail in U.S. Pat. No. 6,310,011 and references cited therein.

The overbased detergent can also be an overbased salicylate, e.g., an alkali metal or alkaline earth metal or ammonium salt of a substituted salicylic acid. The salicylic acids may be hydrocarbyl-substituted wherein each substituent contains an average of at least 8 carbon atoms per substituent and 1 to 3 substituents per molecule. The substituents can be polyalkene substituents. In one embodiment, the hydrocarbyl substituent group contains 7 to 300 carbon atoms and can be an alkyl group having a molecular weight of 150 to 2000. Overbased salicylate detergents and their methods of preparation are disclosed in U.S. Pat. Nos. 4,719,023 and 3,372,116.

Other overbased detergents can include overbased detergents having a Mannich base structure, as disclosed in U.S. Pat. No. 6,569,818.

In certain embodiments, the hydrocarbyl substituents on hydroxy-substituted aromatic rings in the above detergents (e.g., phenate, saligenin, salixarate, glyoxylate, or salicylate) are free of or substantially free of C12 aliphatic hydrocarbyl groups (e.g., less than 1%, 0.1%, or 0.01% by weight of the substituents are C12 aliphatic hydrocarbyl groups). In some embodiments such hydrocarbyl substituents contain at least 14 or at least 18 carbon atoms.

The amount of the overbased detergent, in the formulations of the present technology, is typically at least 0.6 weight percent on an oil-free basis, or 0.7 to 5 weight percent or 1 to 3 weight percent. Either a single detergent or multiple detergents can be present.

In certain embodiments, the lubricant may comprise an overbased sulfonate detergent present at 0.01 wt % to 0.9 wt %, or 0.05 wt % to 0.8 wt %, or 0.1 wt % to 0.7 wt %, or 0.2 wt % to 0.6 wt %. The overbased sulfonate detergent may have a metal ratio of 12 to less than 20, or 12 to 18, or 20 to 30, or 22 to 25. In one embodiment the overbased sulfonate detergent comprises an overbased calcium sulfonate. The calcium sulfonate detergent may have a metal ratio of 18 to 40 and a TBN of 300 to 500, or 325 to 425.

In other embodiments, the overbased detergent may be present at 0 wt % to 10 wt %, or 0.1 wt % to 10 wt %, or 0.2 wt % to 8 wt %, or 0.2 wt % to 3 wt %. For example, in a heavy duty diesel engine the detergent may be present at 2 wt % to 3 wt % of the lubricant composition. For a passenger car engine, the detergent may be present at 0.2 wt % to 1 wt % of the lubricant composition. In one embodiment, an engine lubricant composition comprises at least one overbased detergent with a metal ratio of at least 3, or at least 8, or at least 15.

In certain embodiments, a lubricant employing the present technology may have an entire TBN, from all sources, of at least 5 or at least 6, 7, 8, 9, or 10, and may have a TBN of up to (or less than) 25, 20, or 15. In certain embodiments, a lubricant employing the present technology may have an entire TBN, from all sources, of 5 to 15 or 6 to 10, where the amine compound of the invention is present in an amount to provide 0.5 to 3 TBN of the lubricant composition, where an overbased detergent is present in an amount to deliver 2 to 12 TBN or 4 to 8 TBN and the sulfated ash of the lubricant composition is 0.3 weight percent to 1.1 weight percent. In certain embodiments, a lubricant employing the present technology may have a sulfated ash content of less than 1.5 or less than 1.3 or 1.0 or 0.8 percent (by ASTM D 874) or may be at least 0.05 or 0.1 percent.

As used in this document, expressions such as "represented by the formula" indicate that the formula presented is generally representative of the structure of the chemical in question. However, minor variations can occur, such as positional isomerization. Such variations are intended to be encompassed.

Dispersants are well known in the field of lubricants and include primarily what is known as ashless dispersants and polymeric dispersants. Ashless dispersants are so-called because, as supplied, they do not contain metal and thus do not normally contribute to sulfated ash when added to a lubricant. However they may, of course, interact with ambient metals once they are added to a lubricant which includes metal-containing species. Ashless dispersants are characterized by a polar group attached to a relatively high molecular weight hydrocarbon chain. Typical ashless dispersants include N-substituted long chain alkenyl succinimides, having a variety of chemical structures including typically

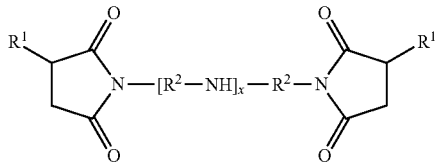

where each $R^1$ is independently an alkyl group, frequently a polyisobutylene group with a molecular weight ($M_n$) of 500-5000 based on the polyisobutylene precursor, and $R^2$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. In the above structure, the amine portion is shown as an alkylene polyamine, although other aliphatic and aromatic mono- and polyamines may also be used. Also, a variety of modes of linkage of the $R^1$ groups onto the imide structure are possible, including various cyclic linkages. The ratio of the carbonyl groups of the acylating agent to the nitrogen atoms of the amine may be 1:0.5 to 1:3, and in other instances 1:1 to 1:2.75 or 1:1.5 to 1:2.5. Succinimide dispersants are more fully described in U.S. Pat. Nos. 4,234,435 and 3,172,892 and in EP 0355895.

Another class of ashless dispersant is high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Another class of ashless dispersant is Mannich bases. These are materials which are formed by the condensation of a higher molecular weight, alkyl substituted phenol, an alkylene polyamine, and an aldehyde such as formaldehyde. Such materials may have the general structure

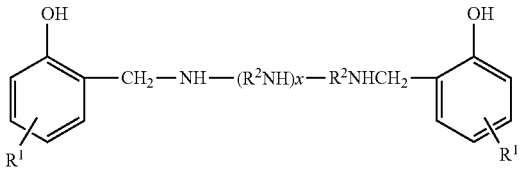

(including a variety of isomers and the like) and are described in more detail in U.S. Pat. No. 3,634,515.

Other dispersants include polymeric dispersant additives, which are generally hydrocarbon-based polymers which contain polar functionality to impart dispersancy characteristics to the polymer.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403.

The amount of the dispersant in a fully formulated lubricant of the present technology may be at least 0.1% of the lubricant composition, or at least 0.3% or 0.5% or 1%, and in certain embodiments at most 9% or 8% or 6% or 4% or 3% or 2% by weight.

Another component frequently used is a viscosity modifier. Viscosity modifiers (VM) and dispersant viscosity modifiers (DVM) are well known. Examples of VMs and DVMs may include polymethacrylates, polyacrylates, polyolefins, hydrogenated vinyl aromatic-diene copolymers (e.g., styrene-butadiene, styrene-isoprene), styrene-maleic ester copolymers, and similar polymeric substances including homopolymers, copolymers, and graft copolymers. The DVM may comprise a nitrogen-containing methacrylate polymer, for example, a nitrogen-containing methacrylate polymer derived from methyl methacrylate and dimethylaminopropyl amine.

Examples of commercially available VMs, DVMs and their chemical types may include the following: polyisobutylenes (such as Indopol™ from BP Amoco or Parapol™ from ExxonMobil); olefin copolymers (such as Lubrizol™ 7060, 7065, and 7067 from Lubrizol and Lucant™ HC-2000L and HC-600 from Mitsui); hydrogenated styrene-diene copolymers (such as Shellvis™ 40 and 50, from Shell and LZ® 7308, and 7318 from Lubrizol); styrene/maleate copolymers, which are dispersant copolymers (such as LZ® 3702 and 3715 from Lubrizol); polymethacrylates, some of which have dispersant properties (such as those in the Viscoplex™ series from RohMax, the Hitec™ series of viscosity index improvers from Afton, and LZ® 7702, LZ® 7727, LZ® 7725 and LZ® 7720C from Lubrizol); olefin-graft-polymethacrylate polymers (such as Viscoplex™ 2-500 and 2-600 from RohMax); and hydrogenated polyisoprene star polymers (such as Shellvis™ 200 and 260, from Shell). Viscosity modifiers that may be used are described in U.S. Pat. Nos. 5,157,088, 5,256,752 and 5,395,539. The VMs and/or DVMs may be used in the functional fluid at a concentration of up to 20% by weight. Concentrations of 1 to 12%, or 3 to 10% by weight may be used.

Another component may be an antioxidant. Antioxidants encompass phenolic antioxidants, which may be hindered phenolic antioxidants, one or both ortho positions on a phenolic ring being occupied by bulky groups such as t-butyl. The para position may also be occupied by a hydrocarbyl group or a group bridging two aromatic rings. In certain embodiments the para position is occupied by an ester-containing group, such as, for example, an antioxidant of the formula

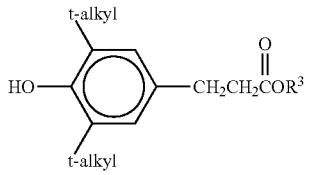

wherein $R^3$ is a hydrocarbyl group such as an alkyl group containing, e.g., 1 to 18 or 2 to 12 or 2 to 8 or 2 to 6 carbon atoms; and t-alkyl can be t-butyl. Such antioxidants are described in greater detail in U.S. Pat. No. 6,559,105.

Antioxidants also include aromatic amines. In one embodiment, an aromatic amine antioxidant can comprise an alkylated diphenylamine such as nonylated diphenylamine or a mixture of a di-nonylated and a mono-nonylated diphenylamine, or an alkylated phenylnaphthylamine, or mixtures thereof.

Antioxidants also include sulfurized olefins such as mono- or disulfides or mixtures thereof. These materials generally have sulfide linkages of 1 to 10 sulfur atoms, e.g., 1 to 4, or 1 or 2. Materials which can be sulfurized to form the sulfurized organic compositions of the present invention include oils, fatty acids and esters, olefins and polyolefins made thereof, terpenes, or Diels-Alder adducts. Details of methods of preparing some such sulfurized materials can be found in U.S. Pat. Nos. 3,471,404 and 4,191,659.

Molybdenum compounds can also serve as antioxidants, and these materials can also serve in various other functions, such as antiwear agents or friction modifiers. U.S. Pat. No. 4,285,822 discloses lubricating oil compositions containing a molyb-denum- and sulfur-containing composition prepared by combining a polar solvent, an acidic molybdenum compound and an oil-soluble basic nitrogen compound to form a molybdenum-containing complex and contacting the complex with carbon disulfide to form the molybdenum- and sulfur-containing composition.

Other materials that may serve as antioxidants include titanium compounds. U.S. Patent Application Publication 2006-0217271 discloses a variety of titanium compounds, including titanium alkoxides and titanated dispersants, which materials may also impart improvements in deposit control and filterability. Other titanium compounds include titanium carboxylates such as neodecanoate.

Typical amounts of antioxidants will, of course, depend on the specific antioxidant and its individual effectiveness, but illustrative total amounts can be 0.01 to 5 percent by weight or 0.15 to 4.5 percent or 0.2 to 4 percent.

The lubricant may also contain a metal salt of a phosphorus acid, which may have many functions including that of an antiwear agent. Metal salts of the formula $$[(R^8O)(R^9O)P(=S)—S]_n\text{-}M$$

where $R^8$ and $R^9$ are independently hydrocarbyl groups containing 3 to 30 carbon atoms, are readily obtainable by heating phosphorus pentasulfide ($P_2S_5$) and an alcohol or phenol to form an O,O-dihydrocarbyl phosphorodithioic acid. The alcohol which reacts to provide the $R^8$ and $R^9$ groups may be a mixture of alcohols, for instance, a mixture of isopropanol and 4-methyl-2-pentanol, and in some embodiments a mixture of a secondary alcohol and a primary alcohol, such as isopropanol and 2-ethylhexanol. The resulting acid may be reacted with a basic metal compound to form the salt. The metal M, having a valence n, generally is aluminum, lead, tin, manganese, cobalt, nickel, zinc, or copper, and in many cases, zinc, to form zinc dialkyldithiophosphates (ZDP). Such materials are well known and readily available to those skilled in the art of lubricant formulation. Suitable variations to provide good phosphorus retention in an engine are disclosed, for instance, in US published application 2008-0015129, see, e.g., claims.

Examples of materials that may serve as anti-wear agents include phosphorus-containing antiwear/extreme pressure agents such as metal thiophosphates as described above, phosphoric acid esters and salts thereof, phosphorus-containing carboxylic acids, esters, ethers, and amides; and phosphites. In certain embodiments a phosphorus antiwear agent may be present in an amount to deliver 0.01 to 0.2 or 0.015 to 0.15 or 0.02 to 0.1 or 0.025 to 0.08 percent phosphorus. Often the antiwear agent is a zinc dialkyldithiophosphate (ZDP). For a typical ZDP, which may contain 11 percent P (calculated on an oil free basis), suitable amounts may include 0.09 to 0.82 percent. Non-phosphorus-containing anti-wear agents include borate esters (including borated epoxides), dithiocarbamate compounds, molybdenum-containing compounds, and sulfurized olefins.

Other materials that may be used as antiwear agents include tartrate esters, tartramides, and tartrimides. Examples include oleyl tartrimide (the imide formed from oleylamine and tartaric acid) and oleyl diesters (from, e.g., mixed C12-16 alcohols). Other related materials that may be useful include esters, amides, and imides of other hydroxycarboxylic acids in general, including hydroxy-polycarboxylic acids, for instance, acids such as tartaric acid, citric acid, lactic acid, glycolic acid, hydroxy-propionic acid, hydroxyglutaric acid, and mixtures thereof. These materials may also impart additional functionality to a lubricant beyond antiwear performance. These materials are described in greater detail in US Publication 2006-0079413 and PCT publication WO2010/077630. Such derivatives of (or compounds derived from) a hydroxy-carboxylic acid, if present, may typically be present in the lubricating composition in an amount of 0.1 weight % to 5 weight %, or 0.2 weight % to 3 weight %, or greater than 0.2 weight % to 3 weight %.

Other additives that may optionally be used in lubricating oils include pour point depressing agents, extreme pressure agents, anti-wear agents, color stabilizers and anti-foam agents.

In different embodiments the lubricating composition may have a composition as described in the following table:

| | Embodiments (wt %) | | |
|---|---|---|---|
| Additive | A | B | C |
| Amine of Present Technology | 0.05 to 1 | 0.2 to 3 | 0.5 to 2 |
| Dispersant | 0.05 to 12 | 0.75 to 8 | 0.5 to 6 |
| Dispersant Viscosity Modifier | 0 or 0.05 to 5 | 0 or 0.05 to 4 | 0.05 to 2 |

-continued

| | Embodiments (wt %) | | |
|---|---|---|---|
| Additive | A | B | C |
| Overbased Detergent | 0 or 0.05 to 15 | 0.1 to 10 | 0.2 to 8 |
| Antioxidant | 0 or 0.05 to 15 | 0.1 to 10 | 0.5 to 5 |
| Antiwear Agent | 0 or 0.05 to 15 | 0.1 to 10 | 0.3 to 5 |
| Friction Modifier | 0 or 0.05 to 6 | 0.05 to 4 | 0.1 to 2 |
| Viscosity Modifier | 0 or 0.05 to 10 | 0.5 to 8 | 1 to 6 |
| Any Other Performance Additive | 0 or 0.05 to 10 | 0 or 0.05 to 8 | 0 or 0.05 to 6 |
| Oil of Lubricating Viscosity | | Balance to 100% | |

The lubricant composition may further comprise: 0.1 wt % to 6 wt %, or 0.4 wt % to 3 wt % of an overbased detergent chosen from a calcium or magnesium non-sulfur containing phenate, a calcium or magnesium a sulfur containing phenate, or a calcium or magnesium sulfonate; 0.5 wt % to 10 wt %, or 1.2 wt % to 6 wt % a polyisobutylene succinimide, wherein the polyisobutyl en e of the polyisobutylene succinimide has a number average molecular weight of 550 to 3000, or 1550 to 2550, or 1950 to 2250; 0.05 wt % to 5 wt %, or 0.1 wt % to 2 wt % of an ethylene-propylene copolymer; 0.1 wt % to 5 wt %, or 0.3 wt % to 2 wt % of the δ-aminoester, and zinc dialkyldithiophosphate present in an amount to deliver 0 ppm to 1100 ppm, or 100 ppm to 800 ppm, or 200 to 500 ppm of phosphorus.

The lubricant composition of the present technology can find use in various applications including as a lubricant composition for an internal combustion engine such as a gasoline or spark-ignited engine such as a passenger car engine, a diesel or compression-ignited engine such as a passenger car diesel engine, heavy duty diesel truck engine, a natural gas fueled engine such as a stationary power engine, an alcohol-fueled engine, a mixed gasoline/alcohol fueled engine, a bio-diesel fueled engine, a hydrogen-fueled engine, a two-cycle engine, an aviation piston or turbine engine, or a marine or railroad diesel engine. In one embodiment the internal combustion engine may be a diesel fueled engine and in another embodiment a gasoline fueled engine, or hydrogen-fueled engines. The internal combustion engine may be fitted with an emission control system or a turbocharger. Examples of emission control systems include diesel particulate filters (DPF) and systems employing selective catalytic reduction (SCR).

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

Example 1

Preparation of an N-hydrocarbyl-substituted δ-aminoester. Bis(2-ethylhexyl)-2-methyleneglutaric acid (48.9 g), methanol (100 g), and 5.0 g of a Zr based catalyst are charged to a 250 mL 3-neck flask fitted with a condenser, magnetic stirrer, nitrogen inlet, and thermocouple. (The Zr catalyst is prepared by combining an aqueous solution of 33.5 g $ZrOCl_2$ with 66.5 g montmorillonite clay with heating followed by drying.) The mixture is stirred at room temperature and 16.3 g of 2-ethylhexylamine is added dropwise over 15 minutes (or alternatively, 3-4 minutes), during which time the temperature of the mixture is 18-27° C. (alternatively, up to 30° C. or 33° C.). The mixture is stirred for an additional 5 hours, then filtered to remove the catalyst. Methanol is removed from the filtrate by rotary vacuum drying under high vacuum, maintaining the temperature below 25° C. The product will be bis(2-ethylhexyl) 2((2-ethylhexyl)amino)methyl glutarate and will have a measurable TBN by D4739 while containing substantially no metal (will be ash-free).

In addition to Example 1, a series of δ-aminoesters of the invention are summarized in Table 1 below based upon the structure:

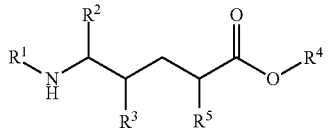

TABLE 1

| | $R^1$ | $R^2$ | $R^3$ | $R^4$ | $R^5$ |
|---|---|---|---|---|---|
| Example 1 | 2-ethylhexyl | H | —C(O)OR[4] | 2-Ethylhexyl | H |
| Example 2 | Ethylbenzene[1] | H | H | n-butyl | H |
| Example 3 | Ethylbenzene[1] | H | H | 2-ethylhexyl | H |
| Example 4 | 2-Ethylhexyl | H | H | n-butyl | H |
| Example 5 | 2-Ethylhexyl | H | H | 2-ethylhexyl | H |
| Example 6 | 2,4,4-trimethyl pentane[2] | H | H | n-butyl | H |

[1]N attached at the 1 position
[2]N attached at the 2 position

Comparative example 8 (Comp Ex 8) is 3-[bis-(2-hydroxy-ethyl)-amino]-propionic acid 2-ethyl-hexyl ester as represented by

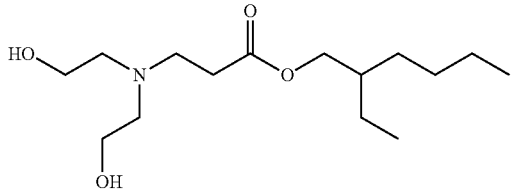

Varying amounts of the product of Examples 1, 2, or 3 or Comparative Example 8 are added to a baseline lubricant formulation containing conventional amounts of one or more viscosity modifiers, pour point depressants, succinimide and other dispersants, dispersant-viscosity modifiers, overbased calcium sulfonate and phenate detergents, zinc dialkyldithiophosphates, antioxidants, corrosion inhibitors, and antifoam agents as specified in Table 2 below. The lubricants will exhibit basicity (TBN) arising from the amino group in the δ-aminoester. The lubricant samples are subjected to a 168 hour, 150° C. fluorocarbon seal compatibility test. Seal materials ("MB"—Mercedes Benz seals) are evaluated before and after immersion in the lubricants under the stated conditions. The compositions of Examples 10-14 will exhibit good fluorocarbon seal compatibility.

TABLE 2

Lubricating Oil Composition Formulations[1]

| | COMP EX9 | EX10 | EX11 | EX12 | EX13 | EX14 |
|---|---|---|---|---|---|---|
| Group II Base Oil | | Balance to = 100% | | | | |
| Example 1 | | 1.0 | 2.0 | | | |
| Example 2 | | | | 0.5 | 1.0 | |
| Example 3 | | | | | | 1.0 |
| Comp Ex 8 | 1.0 | | | | | |
| Ca Detergent[2] | 1.0 | 1.0 | 1.0 | 1.0 | 1.0 | 1.0 |
| Ca Phenate[3] | 0.76 | 0.76 | 0.76 | 0.76 | 0.76 | 0.76 |
| Dispersant[4] | 4.5 | 4.5 | 4.5 | 4.5 | 4.5 | 4.5 |
| Antioxidants[5] | 1.3 | 1.3 | 1.3 | 1.3 | 1.3 | 1.3 |
| ZDDP | 1.1 | 1.1 | 1.1 | 1.1 | 1.1 | 1.1 |
| VI Improver | 1.0 | 1.0 | 1.0 | 1.0 | 1.0 | 1.0 |
| Additional Additives[6] | 0.5 | 0.5 | 0.5 | 0.5 | 0.5 | 0.5 |
| % Phosphorus[7] | 0.11 | 0.11 | 0.11 | 0.11 | 0.11 | 0.11 |
| % Calcium[7] | 0.19 | 0.19 | 0.19 | 0.19 | 0.19 | 0.19 |
| TBN[7] | 8.9 | 8.3 | 9.1 | 8.3 | 9.2 | 8.9 |
| % Ash[7] | 0.85 | 0.85 | 0.85 | 0.85 | 0.85 | 0.85 |

[1]All amounts shown above are in weight percent and are on an oil-free basis unless otherwise noted.
[2]One or more overbased calcium alkylbenzene sulfonic acid with TBN at least 300 and metal ratio at least 10
[3]145 TBN overbased calcium phenate
[4]Includes polyisobutene-substituted succinimide dispersant as well as aromatic amine-containing soot dispersant
[5]Combination of hindered phenol ester, alkylated diarylamine, and sulfurized olefin
[6]The additional additives used in the examples may include friction modifiers, pour point depressants, anti-foam agents, corrosion inhibitors, and may include some amount of diluent oil.
[7]Calculated values, from formulation Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A lubricant composition comprising:

an oil of lubricating viscosity; and an N-hydrocarbyl-substituted δ-aminoester or δ-aminothioester represented by the formula

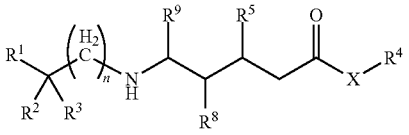

wherein, n is 0 or 1, $R^1$ is hydrogen or a hydrocarbyl group, $R^2$ and $R^3$ are independently hydrocarbyl groups or together form a carbocyclic structure, X is O or S,

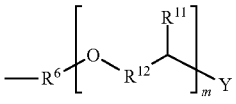

$R^4$ is represented by wherein, $R^6$ is a hydrocarbyl group of 1 to 30 carbon atoms;

$R^{11}$ is H or a hydrocarbyl group of 1 to 10 carbon atoms;

$R^{12}$ is a straight or branched chain hydrocarbylene group of 1 to 6 carbon atoms;

Y is —H, —OH, —$R^6$OH, —$NR^9R^{10}$, or —$R^6NR^9R^{10}$, where $R^9$ and $R^{10}$ are each independently H or a hydrocarbyl group of 1 to 50 carbon atoms, m is an integer from 2 to 50; and $R^5$, $R^8$, and $R^9$ are the same or different and are hydrogen or a hydrocarbyl group, or a group represented by —C(=O)—$R^6$ where $R^6$ is hydrogen, an alkyl group, or —X'—$R^7$, where X' is O or S and $R^7$ is a hydrocarbyl group of 1 to 30 carbon atoms, provided that if $R^4$ is methyl, then n is 0, and further provided that if n is 0, $R^1$ is hydrogen.

2. The lubricant composition of claim 1 wherein X is O.

3. The lubricant composition of claim 1 further comprising at least one of detergents, dispersants, antioxidants, or zinc dialkyldithiophosphates.

4. The lubricant composition of claim 1 further comprising a phosphorus-containing antiwear agent.

5. The lubricant composition of claim 4 wherein the phosphorus-containing antiwear agent comprises a zinc dialkyldithiophosphate.

6. The lubricant composition of claim 1 wherein the N-hydrocarbyl-substituted δ-aminoester or δ-aminothioester is present in an amount of 0.1 to 5 percent by weight or 0.5 to 5, or 0.2 to 4, or 0.1 to 2, or 0.8 to 4, or 1 to 3 percent by weight.

7. The lubricant composition of claim 1, wherein the aminoester or aminothioester is present in an amount sufficient to deliver 0.5 to 3 TBN to the lubricant composition, and wherein the lubricant composition further comprises an overbased metal-containing detergent present in an amount to provide deliver 2 to 8 TBN to the lubricant composition.

8. The lubricant composition of claim 1, further comprising an ashless dispersant in an amount of 0.5 weight percent to 10 weight percent.

9. A method for lubricating a mechanical device, comprising supplying thereto the lubricant composition of claim 1.

* * * * *